United States Patent [19]

Maringer

[11] Patent Number: 4,942,918

[45] Date of Patent: Jul. 24, 1990

[54] CONTROLLED-FLOW FIBER CASTING

[76] Inventor: Robert E. Maringer, 815 Greenridge, Worthington, Ohio 43085

[21] Appl. No.: 249,618

[22] Filed: Sep. 26, 1988

[51] Int. Cl.[5] ..... B22D 11/06; B22D 11/10

[52] U.S. Cl. ..... 164/463; 164/423; 164/429; 164/437; 164/479

[58] Field of Search ..... 164/463, 423, 437, 337, 164/335, 429, 479

[56] References Cited

U.S. PATENT DOCUMENTS

| | | | |
|---|---|---|---|
| 3,871,439 | 3/1975 | Maringer et al. | 164/423 |
| 3,908,745 | 9/1975 | Caldwell et al. | 164/423 |
| 4,475,583 | 10/1984 | Ames | 164/429 |
| 4,719,963 | 1/1988 | Schenk et al. | 164/479 |
| 4,763,718 | 8/1988 | Maringer | 164/423 |
| 4,783,900 | 11/1988 | Hathaway et al. | 164/463 |
| 4,793,400 | 12/1988 | Wood | 164/463 |

FOREIGN PATENT DOCUMENTS

| | | | |
|---|---|---|---|
| 505052 | of 1951 | Belgium | 164/260 |
| 147912 | 7/1985 | European Pat. Off. | 164/423 |
| 57-137057 | 8/1982 | Japan | 164/463 |
| 61-296941 | 12/1986 | Japan | 164/423 |
| 63-104759 | 5/1988 | Japan | 164/437 |

*Primary Examiner*—Kuang Y. Lin

*Attorney, Agent, or Firm*—Barry S. Bissell

[57] ABSTRACT

Continuous production of metal fiber is provided by delivering molten metal at low pressure to a multi-edged, rotating casting drum. The metal is delivered through a wide orifice in a tundish frontwall in close proximity to the casting edges. The flow to the orifice is controlled by means of a constrictive channel upstream of the orifice communicating with the source of molten metal.

15 Claims, 3 Drawing Sheets

CONTROLLED-FLOW FIBER CASTING

TECHNICAL FIELD

The invention relates to the direct casting of metal fiber. Various processes have been used to make metal fiber in the past. A common way has been to cast a metal blank and then draw it through a die to elongate and reduce the cross section thereof. Successive drawing steps are used to further reduce the gauge. This process produces strong wire of uniform and smooth cross section, but is quite expensive and has limited utility in making very fine fiber.

Several direct metal forming processes have also been suggested which cast net shape or near-net shape fiber directly from the melt. The so-called melt extraction process, which I have earlier developed, and the melt spin process, are examples. In the melt extraction process, a rotating, multi-edged casting drum can be brought into contact with a pool of molten metal. Metal adheres to the edges and is extracted from the pool to later solidify to a fiber. This process requires sensitive depth control and fairly wide spacing of the edges to prevent webbing of the fiber to each other. Large fiber outputs therefore require large machinery.

Melt spin is another process which uses an orifice to deliver molten metal to rotating, multi-edged casting drum. A positive pressure is used to "squirt" the molten metal onto the edges. The same problems of webbing and larger fiber size may be present in the melt spin process. Moreover, for fine fiber the amount of molten metal is small and the orifice size must be reduced resulting in the potential for plugging.

An additional casting method shown in EP Patent 0 147 912 suggests the possibility of making fiber by overflowing melt from an open tundish onto a rotating casting drum. Flow to the casting surface appears to be controlled by the amount of metal which is allowed to overflow the tundish edge.

SUMMARY OF THE INVENTION

It should be clear that the production of fine fiber requires a sensitive method to control the flow of molten metal to the casting surface. As compared to production of large fiber or of sheet products, for example, the quantities of metal which are needed at the casting surface are much lower. When using a multi-edged drum, the amount of metal needed to produce a fiber on one edge is very small. If too much metal is delivered or at too high a pressure, a webbing of the fibers to each other to form a pseudo-sheet product will result. The control problem is hard enough when only a small number of edges are being cast upon, but since high efficiency requires many casting edges, the problem of delivering the melt across a multitude of closely-spaced casting edges becomes even harder.

The invention is a process for casting fine fiber on a multi-edge casting drum. In particular, the invention is a method of controlling the flow of metal to the wide casting surface. The process in one embodiment comprises providing a cylindrical casting drum having a plurality of substantially parallel casting edges extending circumferentially around the drum, supplying melt to an orifice from a melt supply through a constrictor channel having a cross-sectional area smaller than the cross-sectional area of the orifice and providing a meniscus of melt extending from the orifice, rotating the casting drum such that the casting edges pass through the meniscus of melt and withdraw a melt layer on the casting edges, cooling the casting drum to solidify the layer of melt into fibers on the casting edges, and removing the fibers from the casting edges.

For efficient production, a wide casting drum having a multiplicity of closely-spaced casting edges is utilized. The orifice is then generally rectangular in cross-section having a length substantially larger than its height, and having the height aligned substantially parallel to the rotation of the casting edges.

The controlled delivery of metal can be accomplished by means of a novel tundish comprising sidewalls and a floor defining a reservoir for molten metal, an orifice in the sidewalls or floor of the tundish, and a constrictor channel in the tundish communicating the reservoir with the orifice, wherein the constrictor channel has a cross-sectional area less than the orifice.

DESCRIPTION OF THE PREFERRED EMBODIMENTS

Figure 3A:
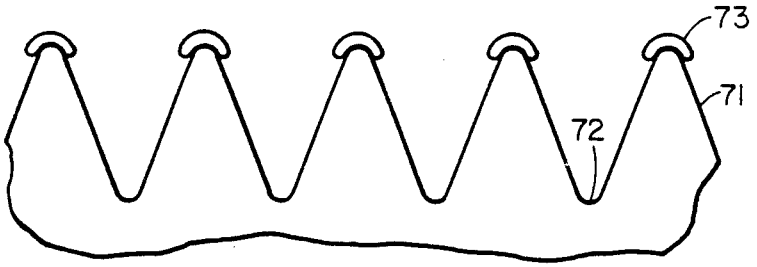
Figure 3B:
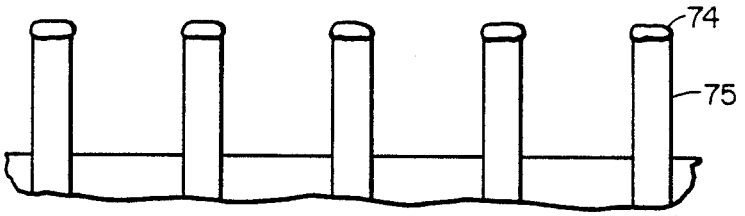
Figure 3C:
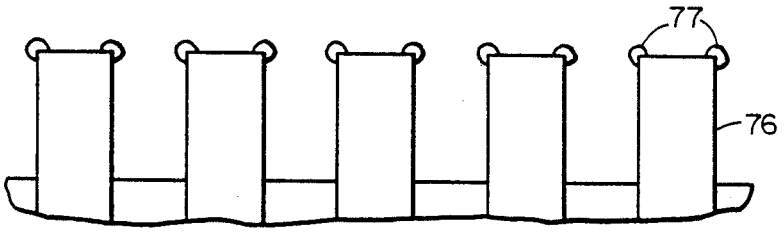

FIGS. 3*a*–3*c* is a representation of the closely-spaced casting edges and the adherent fiber.

FIGS. 4*a*–6*c* are views of alternative embodiments of the novel tundish.

In casting fine fiber or filament, it must be recognized that the volume of material, Q, cast from a single edge per unit time is very small, $$Q=(\pi D^2/4)V \quad (1)$$

where D is the fiber diameter and V is the velocity of the drum.

For example, the volume of melt needed to cast a 0.1 mm diameter filament at 20 m/sec is 0.0157 ml/sec. Productivity can be increased by increasing drum speed, but this has limitations because of the wind effects and machine design considerations.

Productivity can also be increased by increasing the number of casting edges on the drum. For a drum with 20 edges, productivity under the above conditions would be 0.314 ml/sec. If one neglects the frictional effects, the rate at which metal will flow through an orifice is given by $Q=A(2\ gh)^{\frac{1}{2}}$, where A is the area of the orifice, g is the acceleration of gravity and h is the head height of the molten metal above the orifice. Assuming a rectangular orifice of 2.5 by 0.050 cm and a head height of 2.5 cm, the quantity of metal flowing through the orifice is about 2.62 ml/sec, roughly 8 times the need. The needed metal could be provided by reducing the area of the orifice to $\frac{1}{8}$ of its size. But since the length of the orifice must stay equal to the casting drum width, the orifice height would have to be reduced. This would suggest an orifice of 2.5 cm by 0.006 cm, which is both difficult to machine and to operate. Wider casting drums would obviously exacerbate this problem.

The present invention provides a constriction upstream of the narrow orifice to solve this delivery problem. The dimensions of a constriction channel upstream of the orifice are not dependent on the width of the casting drum and can be reduced in size by any dimension (ie. length, width, diameter) as is convenient. For example, since the volume through a round channel is a function of the square of the diameter, a channel 0.14 cm in diameter would supply the needed metal on the above facts. This is a much easier orifice to machine and operate than a 0.006 cm (height) orifice.

Figure 1:
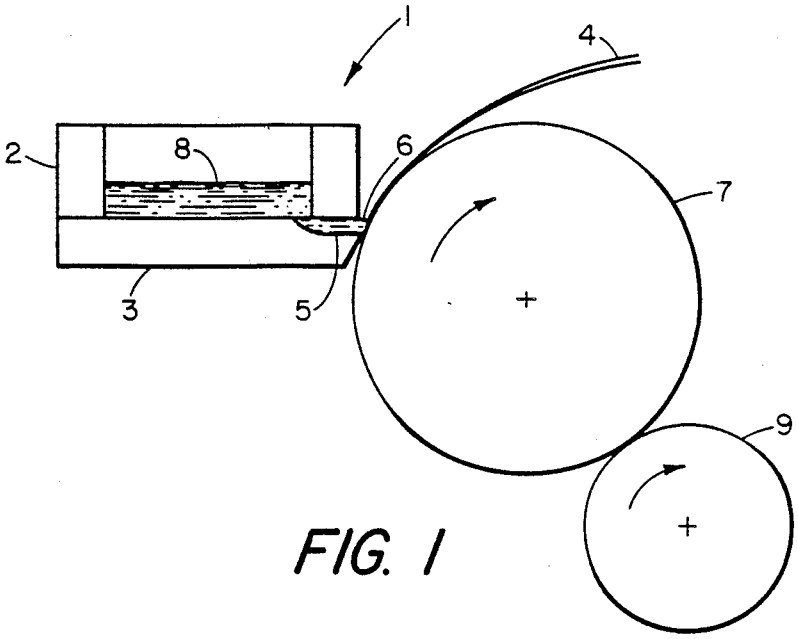
FIG. 1 shows a schematic of a generalized arrangement of the apparatus of the invention.

FIG. 1 shows a schematic of generalized apparatus for making fiber on a casting drum. A tundish 1 is comprised of walls 2 and a bottom 3 providing a reservoir for molten metal 8. An orifice 5 communicates with the reservoir for conveying metal to casting drum 7. The drum is a cylindrical drum which is cooled by conventional means (not shown). The metal forms a meniscus 6 at the exit of the orifice which is contacted by the casting edges of the casting drum. The casting edges may be formed by circumferentially grooving the outer surface of the drum. The grooves may be helical for ease of machining, but are preferably separate circular grooves such as shown in FIG. 3. The casting edges extract a layer of molten metal from the meniscus. Subsequently, the metal solidifies to a fiber product 4 which is thrown from the drum. A wiper 9 may be used to clean or condition the drum on each rotation.

Figure 2:
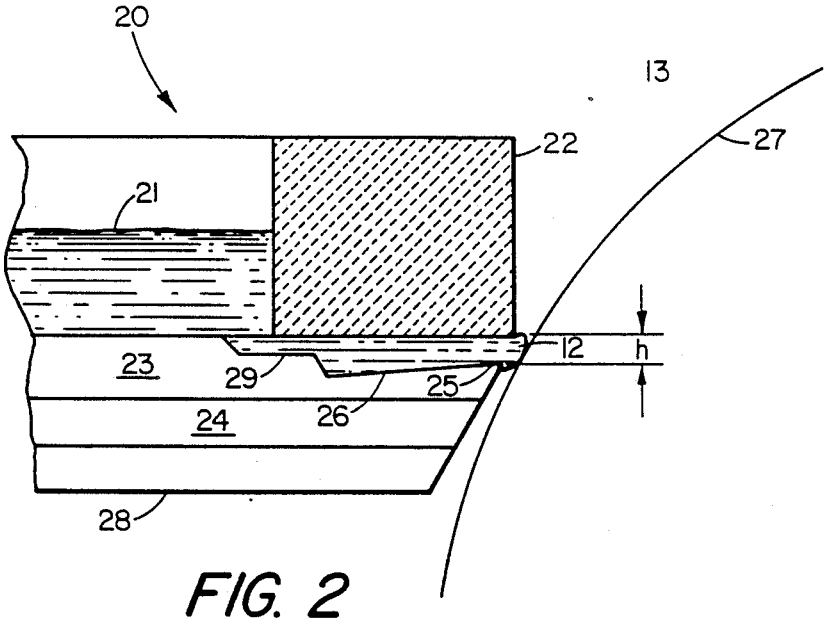
FIG. 2 is a breakaway section view of the tundish in proximity to the casting drum.

FIG. 2 shows a close up section view of the casting region of the inventive tundish 20. Walls 22 and bottom plate 23 again form a reservoir for molten metal 21. A heater 24 and a lower plate 28 are also shown in this embodiment. The heater is useful for maintaining the viscosity of the melt as it passes through the orifice to the casting drum. The bottom plate 23 has been machined to form an orifice 25 and a constrictor channel 29 with the front wall of the tundish. The constrictor channel has a cross-sectional area less than the orifice. Preferably, the constrictor channel has an area which cooperates with the head pressure and other variables to deliver substantially the exact requirements of the casting process as hereinafter defined.

The melt flows through the constrictor channel and the orifice to form a meniscus 12 at the tundish boundary. Casting edges (such as shown in FIG. 3) on drum 27 rotate substantially parallel to the height, h, of the orifice. A relief area 26 may be cut in the orifice or upstream of the orifice to aid in spreading melt across the orifice length and making the flow therein more uniform. A deeper relief near the constrictor channel and slightly more shallow relief area nearer the orifice exit has been found to be beneficial to spreading of the melt from the relatively narrow constrictor channel to the longer orifice. In addition, or in the alternative, a vibration can be used to help spread the melt across the orifice.

FIG. 3(*a*) shows a cross section of one embodiment of the casting edges 71 which may be utilized in the inventive method. The edges are formed in any number of ways, but preferably by machining grooves 72 in the outside surface of the cylindrical drum. The edges may take any configuration which is substantially circumferential around the drum. Preferably, they are closely spaced and substantially parallel. Separate grooves are favored over helical grooves. As the edges are contacted with the melt, a layer of melt 73 is extracted. Subsequent cooling solidifies the layer to a fiber.

The angle of the grooves is not particularly critical. Standard screw thread angles of about 60° have been used. Larger angles will generally produce larger fiber, especially as the tips may become rounded by wear during use. It is believed that webbing of the fibers to each other will occur if the fiber width becomes too large relative to the spacing between casting edges. Spacing between adjacent fibers of about 5–10 times the fiber width has been successfully used. For 0.1 mm fiber, I have used edge spacing of 0.75–1.4 mm, which is roughly equivalent to 7–13 edges per cm.

FIGS. 3(*b*) and 3(*c*) show another embodiment of the casting edges. In this embodiment, the edges are squared instead of rounded. This type of design could most easily be made by stacking disks or annular rings. If the edges are fairly narrow as shown in FIG. 3(*b*), the fiber 74 may be formed on the top surface of the "edge" 75. If the edge is somewhat wider as in FIG. 3(*c*), the fibers 77 can be formed at the corners of the "edges" 76. These fibers tend to be very small. Reduction of the head pressure may be used to produce these fibers at the corners. The squared edges have the advantage that they can be polished or dressed with a flat tool and they still retain their squared profile. The rounded edges of FIG. 3(*a*) are flattened by dressing.

Wear can cause a reduction in spacing of the edges and an increase in fiber size for given process conditions. It is desirable to make the drums of hard, wear-resistent materials. Copper is useful in some cases, but steel is generally better for its hardness.

The edges and the grooves should be smooth to prevent sticking of the fiber and to limit turbulence in the meniscus. Turbulence can force molten metal into the grooves. Wiping can be used to remove loose debris. Cotton wipes or natural or resin brushes have proven useful. A small amount of oil wiped on the surface appears to help uniform release of the fiber.

Figures 4A, 4B, 4C, 5A, 5B, 5C, 6A, 6B, 6C:
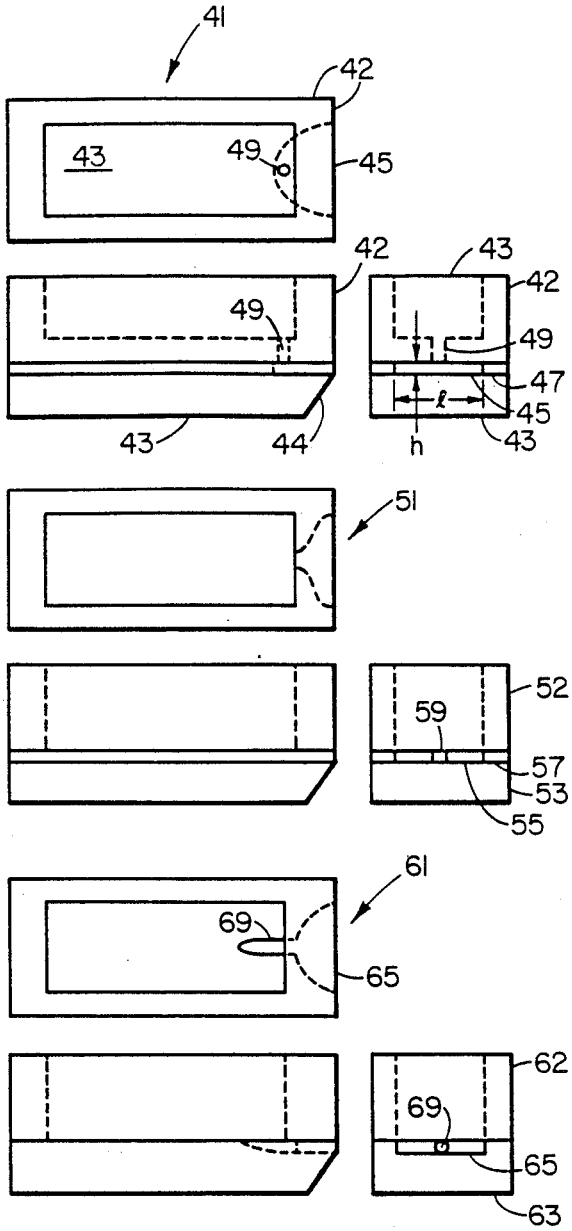

FIGS. 4–6 show alternative embodiments of the tundish according to the invention made of two or three pieces. The tundishes are made of heat-resistent materials, such as insulating ceramics, which can withstand the metal melting temperatures. In FIG. 4, a reservoir for the melt is hollowed out of an upper tundish portion 42. A separate bottom 43 is glued to the upper portion through a spacer plate 47. The spacer 47 is used to carve out the orifice 45. The orifice is semicircular in plan view as shown in FIG. 4*a*, but is rectangular in cross section as it exits the tundish as shown in FIG. 4*c*. The orifice at the exit has a height, h, and a length, l. The length is such that it spans the width of the casting edges to be cast upon on the casting drum. A portion of the bottom 43 is shown removed to form a surface 44 which is closely adjacent the casting drum during operation. The surface 44 should be within about 0.25–0.5 mm from the casting surface. The circular cross section constrictor channel 49 communicating the melt reservoir with the orifice is drilled in the upper piece of the tundish.

FIG. 5 shows another three-piece embodiment 51 of the tundish. The upper piece in this embodiment is not hollowed out to form the reservoir, but the spacer plate 57 forms the reservoir with the sidewalls 52. The constrictor channel 59 is formed in the spacer along with the orifice 55. A bottom 53 completes the tundish.

FIG. 6 is a two piece tundish 61 in which the walls 62 and the bottom 63 form the melt reservoir. A constrictor channel 69 and an orifice 65 are formed in the bottom piece 63.

The process is most easily seen with reference back to FIG. 2. Melt is supplied to a rotating drum from a reservoir through an orifice and an upstream constrictor channel. The amount of metal needed by the process is defined herein to mean the volume per unit time needed to produce the fiber products without loss. For N edges per cm, the amount of metal, M, needed in the process is M=NQ, where Q is calculated according to equation (1) above.

The constrictor channel is sized to deliver the amount needed, M, under the available conditions (head height, etc.). The orifice has generally a rectangular cross section with an area larger than the constrictor channel and with a length equal to the width of the casting surface. The relief areas help spread the melt across the orifice and casting surface.

EXAMPLE

A water-cooled drum 20 cm in diameter was rotated clockwise adjacent a tundish at about the 10 o'clock position though it could be located at about any location around the circumference of the drum. A cotton wiper was used at about the 5 o'clock position. Both copper and steel were tried as casting surfaces. Drum speeds were between 500 and 1500 rpm. Orifices were 2.5 cm in length and between 0.5 mm and 2 mm in width. The constrictor channel was round in cross section and between 1.5 and 2 mm in diameter. Grooves were machined into the casting surfaces at 60° angles and at a density of between 7 and 16 edges per cm. Tin, lead, a zinc alloy, 380 aluminum and a nickel-based amorphous alloy were all tried. The system produced fiber under almost all the above conditions under the parameters described herein.

We claim:

1. A process for directly casting fine metal fibers directly from the melt comprising providing a cylindrical substrate having a casting region defined by a plurality of substantially parallel casting surfaces extending circumferentially therearound, supplying melt from a tundish through a constrictor channel to an elongated orifice in the sidewalls or floor of the tundish having a length at the exit substantially larger than its height and substantially equal to the width of the casting region, and having the height aligned substantially parallel to the rotation of the casting surfaces, said constrictor channel in the tundish communicating the tundish with the orifice having a cross-sectional area smaller than the cross-sectional area of the orifice and having a dimension in the direction of the orifice length at the exit which is substantially less than the length at the exit of the orifice, providing a meniscus of melt extending from the orifice, rotating the cylindrical substrate such that the casting surfaces pass through the meniscus of melt and withdraw a melt layer on the casting surfaces in the casting region, cooling the cylindrical substrate to solidify the layer of melt into fibers on the casting surfaces, and removing the fibers from the casting surfaces.

2. The direct casting process for metal fibers as in claim 1 wherein the melt supply is a melt pool contained in a tundish and wherein the orifice extends in the tundish and exits a sidewall thereof.

3. The direct casting process for metal fibers as in claim 2 which further includes heating the constrictor channel to maintain the viscosity of the melt.

4. The direct casting process for metal fibers as in claim 2 which further includes vibrating the tundish to spread the melt to the orifice.

5. The direct casting process for metal fibers as in claim 1 wherein each casting surface is a sharp edge and which further includes rotating the sharp edges through the meniscus of melt and withdrawing one layer of melt on each sharp edge.

6. The direct casting process for metal fibers as in claim 1 wherein each casting surface comprises a flat cylindrical surface bounded on each side thereof by circular edges and which further includes rotating the casting surfaces through the meniscus of melt and withdrawing one layer of melt on each circular edge.

7. A tundish for delivering molten metal under low pressure to a casting region on a rotatable, cylindrical substrate, the tundish comprising sidewalls and a floor defining a reservoir for molten metal, an elongated orifice in the sidewalls or floor of the tundish, and a constrictor channel in the tundish communicating the reservoir with the orifice, wherein said orifice has a length at the exit substantially larger than its height and substantially equal to the width of the casting region and having its height aligned substantially parallel to the direction of rotation of the cylindrical substrate, and wherein the constrictor channel has a cross-sectional area less than the orifice and a dimension in the direction of the orifice length at the exit which is substantially less than the length at the exit of the orifice.

8. The tundish for delivering molten metal as in claim 7 which further includes means for heating the constrictor channel to maintain the viscosity of the melt.

9. The tundish for delivering molten metal as in claim 7 which further includes means for vibrating the tundish to spread the melt to the orifice.

10. Fiber-casting apparatus comprising a rotatable casting substrate having a casting region defined by a plurality of substantially parallel casting surfaces extending circumferentially around the substrate, a tundish, an elongated orifice in the sidewalls or floor of the tundish for supplying molten metal to the casting surfaces, and a constrictor channel in the tundish communicating the source of molten metal with the orifice, wherein said orifice has a length at the exit substantially larger than its height and substantially equal to the width of the casting region and having its height aligned substantially parallel to the direction of rotation of the casting surfaces, and wherein the constrictor channel has a cross-sectional area less than the orifice and a dimension in the direction of the orifice length at the exit which is substantially less than the length at the exit of the orifice.

11. The fiber-casting apparatus of claim 10 wherein the source of molten metal melt is a tundish comprised of sidewalls and a floor and wherein the orifice extends in the tundish and exits a sidewall thereof.

12. The fiber-casting apparatus of claim 10 which further includes heating means to maintain the viscosity of the melt in the constrictor channel.

13. The fiber-casting apparatus of claim 10 which further includes vibrating means to spread the melt to the orifice.

14. The fiber-casting apparatus of claim 10 wherein each casting surface is a sharp edge.

15. The fiber-casting apparatus of claim 10 wherein each casting surface comprises a flat cylindrical surface bounded on each side thereof by circular edges.

* * * * *